US008358273B2

(12) United States Patent
Hodge et al.

(10) Patent No.: US 8,358,273 B2
(45) Date of Patent: Jan. 22, 2013

(54) PORTABLE MEDIA DEVICE WITH POWER-MANAGED DISPLAY

(75) Inventors: Andrew Bert Hodge, Palo Alto, CA (US); Guy Bar-Nahum, San Francisco, CA (US); Shawn R. Gettemy, San Jose, CA (US); David John Tupman, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 818 days.

(21) Appl. No.: 11/439,613

(22) Filed: May 23, 2006

(65) Prior Publication Data

US 2007/0273714 A1 Nov. 29, 2007

(51) Int. Cl.
*G09G 5/10* (2006.01)

(52) U.S. Cl. ..... 345/169; 345/156

(58) Field of Classification Search ..... 345/156, 345/169

See application file for complete search history.

(56) References Cited

U.S. PATENT DOCUMENTS

| | | | |
|---|---|---|---|
| 4,090,216 | A | 5/1978 | Constable |
| 4,386,345 | A | 5/1983 | Narveson et al. |
| 4,451,849 | A | 5/1984 | Fuhrer |
| 4,589,022 | A | 5/1986 | Prince et al. |
| 4,908,523 | A | 3/1990 | Snowden et al. |
| 4,928,307 | A | 5/1990 | Lynn |
| 4,951,171 | A | 8/1990 | Tran et al. |
| 5,185,906 | A | 2/1993 | Brooks |
| 5,293,494 | A | 3/1994 | Saito et al. |
| 5,379,057 | A | 1/1995 | Clough |
| 5,406,305 | A | 4/1995 | Shimomura et al. |
| 5,559,945 | A | 9/1996 | Beaudet et al. |
| 5,566,337 | A | 10/1996 | Szymanski et al. |
| 5,583,993 | A | 12/1996 | Foster et al. |
| 5,608,698 | A | 3/1997 | Yamanoi et al. |
| 5,616,876 | A | 4/1997 | Cluts |
| 5,617,386 | A | 4/1997 | Choi |
| 5,670,985 | A | 9/1997 | Cappels, Sr. et al. |
| 5,675,362 | A | 10/1997 | Clough |
| 5,684,513 | A | 11/1997 | Decker |
| 5,710,922 | A | 1/1998 | Alley et al. |
| 5,712,949 | A | 1/1998 | Kato et al. |

(Continued)

FOREIGN PATENT DOCUMENTS

CN 1577466 2/2005

(Continued)

OTHER PUBLICATIONS

Apple iTunes Smart Playlists, downloaded Apr. 5, 2005 from http://web.archive.org/web/20031002011316/www.apple.com/itunes/smartplaylists... pp. 1-2.

(Continued)

*Primary Examiner* — Bipin Shalwala
*Assistant Examiner* — Afroza Chowdhury
(74) *Attorney, Agent, or Firm* — Fletcher Yoder PC

(57) ABSTRACT

Improved techniques for controlling power utilization of a display device are disclosed. The improved techniques reduce power consumption by lowering display intensity at appropriate times. In one embodiment, the display intensity can be controlled depending on the type of content being displayed. In another embodiment, the display intensity can be controlled depending on the characteristics of the content being displayed. In still another embodiment, the display intensity can be controlled depending on the type and characteristics of content being displayed. The improved techniques are well suited for use with portable media devices.

37 Claims, 7 Drawing Sheets

U.S. PATENT DOCUMENTS

| | | | | |
|---|---|---|---|---|
| 5,717,422 | A | 2/1998 | Fergason | |
| 5,721,949 | A | 2/1998 | Smith et al. | |
| 5,726,672 | A | 3/1998 | Hernandez et al. | |
| 5,739,451 | A | 4/1998 | Winksy et al. | |
| 5,740,143 | A | 4/1998 | Suetomi | |
| 5,760,588 | A | 6/1998 | Bailey | |
| 5,778,374 | A | 7/1998 | Dang et al. | |
| 5,803,786 | A | 9/1998 | McCormick | |
| 5,815,225 | A | 9/1998 | Nelson | |
| 5,822,288 | A | 10/1998 | Shinada | |
| 5,835,721 | A | 11/1998 | Donahue et al. | |
| 5,835,732 | A | 11/1998 | Kikinis et al. | |
| 5,838,969 | A | 11/1998 | Jacklin et al. | |
| 5,864,868 | A | 1/1999 | Contois | |
| 5,867,163 | A | 2/1999 | Kurtenbach | |
| 5,870,710 | A | 2/1999 | Ozawa et al. | |
| 5,918,303 | A | 6/1999 | Yamaura et al. | |
| 5,920,728 | A | 7/1999 | Hallowell et al. | |
| 5,923,757 | A | 7/1999 | Hocker et al. | |
| 5,929,601 | A | 7/1999 | Kaib et al. | |
| 5,952,992 | A | 9/1999 | Helms | |
| 6,006,274 | A | 12/1999 | Hawkins et al. | |
| 6,009,237 | A | 12/1999 | Hirabayashi et al. | |
| 6,011,585 | A | 1/2000 | Anderson | |
| 6,018,705 | A | 1/2000 | Gaudet et al. | |
| 6,041,023 | A | 3/2000 | Lakhansingh | |
| 6,052,654 | A | 4/2000 | Gaudet et al. | |
| 6,108,426 | A | 8/2000 | Stortz | |
| 6,122,340 | A | 9/2000 | Darley et al. | |
| 6,158,019 | A | 12/2000 | Squibb | |
| 6,161,944 | A | 12/2000 | Leman | |
| 6,169,387 | B1 | 1/2001 | Kaib | |
| 6,172,948 | B1 | 1/2001 | Keller et al. | |
| 6,179,432 | B1 | 1/2001 | Zhang et al. | |
| 6,185,163 | B1 | 2/2001 | Bickford et al. | |
| 6,191,939 | B1 | 2/2001 | Burnett | |
| 6,208,044 | B1 | 3/2001 | Viswanadham et al. | |
| 6,216,131 | B1 | 4/2001 | Liu et al. | |
| 6,217,183 | B1 | 4/2001 | Shipman | |
| 6,248,946 | B1 | 6/2001 | Dwek | |
| 6,295,541 | B1 | 9/2001 | Bodnar et al. | |
| 6,297,795 | B1 | 10/2001 | Kato et al. | |
| 6,298,314 | B1 | 10/2001 | Blackadar et al. | |
| 6,332,175 | B1 | 12/2001 | Birrell et al. | |
| 6,336,365 | B1 | 1/2002 | Blackadar et al. | |
| 6,336,727 | B1 | 1/2002 | Kim | |
| 6,341,316 | B1 | 1/2002 | Kloba et al. | |
| 6,357,147 | B1 | 3/2002 | Darley et al. | |
| 6,377,530 | B1 | 4/2002 | Burrows | |
| 6,452,610 | B1 | 9/2002 | Reinhardt et al. | |
| 6,467,924 | B2 | 10/2002 | Shipman | |
| 6,493,652 | B1 | 12/2002 | Ohlenbusch et al. | |
| 6,536,139 | B2 | 3/2003 | Darley et al. | |
| 6,549,497 | B2 | 4/2003 | Miyamoto et al. | |
| 6,560,903 | B1 | 5/2003 | Darley | |
| 6,587,403 | B1 | 7/2003 | Keller et al. | |
| 6,587,404 | B1 | 7/2003 | Keller et al. | |
| 6,597,339 | B1 * | 7/2003 | Ogawa | 345/102 |
| 6,605,038 | B1 | 8/2003 | Teller et al. | |
| 6,606,281 | B2 | 8/2003 | Cowgill et al. | |
| 6,611,607 | B1 | 8/2003 | Davis et al. | |
| 6,611,789 | B1 | 8/2003 | Darley | |
| 6,617,963 | B1 | 9/2003 | Watters et al. | |
| 6,621,768 | B1 | 9/2003 | Keller et al. | |
| 6,623,427 | B2 | 9/2003 | Mandigo | |
| 6,631,101 | B1 | 10/2003 | Chan et al. | |
| 6,693,612 | B1 | 2/2004 | Matsumoto et al. | |
| 6,731,312 | B2 | 5/2004 | Robbin | |
| 6,760,536 | B1 | 7/2004 | Amir et al. | |
| 6,762,741 | B2 | 7/2004 | Weindorf | |
| 6,781,611 | B1 | 8/2004 | Richard | |
| 6,794,566 | B2 | 9/2004 | Pachet | |
| 6,799,226 | B1 | 9/2004 | Robbin et al. | |
| 6,801,964 | B1 | 10/2004 | Mahdavi | |
| 6,832,373 | B2 | 12/2004 | O'Neill | |
| 6,844,511 | B1 | 1/2005 | Hsu et al. | |
| 6,870,529 | B1 | 3/2005 | Davis | |
| 6,871,063 | B1 | 3/2005 | Schiffer | |
| 6,876,947 | B1 | 4/2005 | Darley et al. | |
| 6,882,955 | B1 | 4/2005 | Ohlenbusch et al. | |
| 6,886,749 | B2 * | 5/2005 | Chiba et al. | 235/454 |
| 6,898,550 | B1 | 5/2005 | Blackadar et al. | |
| 6,911,971 | B2 | 6/2005 | Suzuki et al. | |
| 6,918,677 | B2 | 7/2005 | Shipman | |
| 6,931,377 | B1 | 8/2005 | Seya | |
| 6,934,812 | B1 | 8/2005 | Robbin et al. | |
| 6,937,224 | B1 * | 8/2005 | Miyachi | 345/102 |
| 6,950,087 | B2 | 9/2005 | Knox et al. | |
| 7,010,365 | B2 | 3/2006 | Maymudes | |
| 7,028,096 | B1 | 4/2006 | Lee | |
| 7,046,230 | B2 | 5/2006 | Zadesky et al. | |
| 7,062,225 | B2 | 6/2006 | White | |
| 7,076,561 | B1 | 7/2006 | Rosenberg et al. | |
| 7,079,174 | B2 * | 7/2006 | Taniguchi et al. | 348/51 |
| 7,084,856 | B2 | 8/2006 | Huppi | |
| 7,084,921 | B1 | 8/2006 | Ogawa | |
| 7,092,946 | B2 | 8/2006 | Bodnar | |
| 7,123,141 | B2 | 10/2006 | Contestabile | |
| 7,124,125 | B2 | 10/2006 | Cook et al. | |
| 7,131,059 | B2 | 10/2006 | Obrador | |
| 7,143,241 | B2 | 11/2006 | Hull | |
| 7,146,437 | B2 | 12/2006 | Robbin et al. | |
| 7,171,331 | B2 | 1/2007 | Vock et al. | |
| 7,191,244 | B2 | 3/2007 | Jennings et al. | |
| 7,210,236 | B2 | 5/2007 | Sato et al | |
| 7,213,228 | B2 | 5/2007 | Putterman et al. | |
| 7,234,026 | B2 | 6/2007 | Robbin et al. | |
| 7,268,747 | B2 * | 9/2007 | Taniguchi et al. | 345/6 |
| 7,277,928 | B2 | 10/2007 | Lennon | |
| 7,301,857 | B2 | 11/2007 | Shah et al. | |
| 7,356,679 | B1 | 4/2008 | Le et al. | |
| 7,403,128 | B2 | 7/2008 | Scuka et al. | |
| 7,456,829 | B2 * | 11/2008 | Fry | 345/204 |
| 7,508,535 | B2 | 3/2009 | Hart et al. | |
| 7,522,134 | B2 * | 4/2009 | Mizumaki | 345/87 |
| 7,724,247 | B2 * | 5/2010 | Yamazaki et al. | 345/207 |
| 2001/0013983 | A1 | 8/2001 | Izawa et al. | |
| 2001/0029178 | A1 | 10/2001 | Criss et al. | |
| 2001/0037367 | A1 | 11/2001 | Iyer | |
| 2001/0041021 | A1 | 11/2001 | Boyle et al. | |
| 2001/0042107 | A1 | 11/2001 | Palm | |
| 2002/0002413 | A1 | 1/2002 | Tokue | |
| 2002/0013784 | A1 | 1/2002 | Swanson | |
| 2002/0028683 | A1 | 3/2002 | Banatre et al. | |
| 2002/0045961 | A1 | 4/2002 | Gibbs et al. | |
| 2002/0046315 | A1 | 4/2002 | Miller et al. | |
| 2002/0055934 | A1 | 5/2002 | Lipscomb et al. | |
| 2002/0059440 | A1 | 5/2002 | Hudson et al. | |
| 2002/0059499 | A1 | 5/2002 | Hudson | |
| 2002/0090912 | A1 | 7/2002 | Cannon et al. | |
| 2002/0116082 | A1 | 8/2002 | Gudorf | |
| 2002/0116517 | A1 | 8/2002 | Hudson et al. | |
| 2002/0122031 | A1 | 9/2002 | Maglio et al. | |
| 2002/0123359 | A1 | 9/2002 | Wei et al. | |
| 2002/0152045 | A1 | 10/2002 | Dowling et al. | |
| 2002/0156833 | A1 | 10/2002 | Maurya et al. | |
| 2002/0161865 | A1 | 10/2002 | Nguyen | |
| 2002/0173273 | A1 | 11/2002 | Spurgat et al. | |
| 2002/0189426 | A1 | 12/2002 | Hirade et al. | |
| 2002/0189429 | A1 | 12/2002 | Qian et al. | |
| 2002/0199043 | A1 | 12/2002 | Yin | |
| 2003/0002688 | A1 | 1/2003 | Kanevsky et al. | |
| 2003/0007001 | A1 * | 1/2003 | Zimmerman | 345/716 |
| 2003/0018799 | A1 | 1/2003 | Eyal | |
| 2003/0037254 | A1 | 2/2003 | Fischer et al. | |
| 2003/0046434 | A1 | 3/2003 | Flanagin et al. | |
| 2003/0050092 | A1 | 3/2003 | Yun | |
| 2003/0074457 | A1 | 4/2003 | Kluth | |
| 2003/0076301 | A1 | 4/2003 | Tsuk et al. | |
| 2003/0076306 | A1 | 4/2003 | Zadesky | |
| 2003/0079038 | A1 | 4/2003 | Robbin et al. | |
| 2003/0095096 | A1 | 5/2003 | Robbin et al. | |
| 2003/0097379 | A1 | 5/2003 | Ireton | |
| 2003/0104835 | A1 | 6/2003 | Douhet | |
| 2003/0127307 | A1 | 7/2003 | Liu et al. | |
| 2003/0128192 | A1 | 7/2003 | van Os | |
| 2003/0133694 | A1 | 7/2003 | Yeo | |

| | | | | |
|---|---|---|---|---|
| 2003/0151517 | A1 | 8/2003 | Nishihara et al. | |
| 2003/0153213 | A1 | 8/2003 | Siddiqui et al. | |
| 2003/0156503 | A1 | 8/2003 | Schilling et al. | |
| 2003/0167318 | A1 | 9/2003 | Robbin et al. | |
| 2003/0176935 | A1 | 9/2003 | Lian et al. | |
| 2003/0182100 | A1 | 9/2003 | Plastina et al. | |
| 2003/0221541 | A1 | 12/2003 | Platt | |
| 2003/0229490 | A1 | 12/2003 | Etter | |
| 2003/0236695 | A1 | 12/2003 | Litwin, Jr. | |
| 2004/0001395 | A1 | 1/2004 | Keller et al. | |
| 2004/0001396 | A1 | 1/2004 | Keller et al. | |
| 2004/0012556 | A1 | 1/2004 | Yong et al. | |
| 2004/0055446 | A1 | 3/2004 | Robbin et al. | |
| 2004/0066363 | A1* | 4/2004 | Yamano et al. | 345/98 |
| 2004/0069122 | A1 | 4/2004 | Wilson | |
| 2004/0076086 | A1 | 4/2004 | Keller et al. | |
| 2004/0086120 | A1 | 5/2004 | Akins, III et al. | |
| 2004/0094018 | A1 | 5/2004 | Ueshima et al. | |
| 2004/0103411 | A1 | 5/2004 | Thayer | |
| 2004/0125522 | A1 | 7/2004 | Chiu et al. | |
| 2004/0165302 | A1 | 8/2004 | Lu | |
| 2004/0177063 | A1 | 9/2004 | Weber et al. | |
| 2004/0198436 | A1 | 10/2004 | Alden | |
| 2004/0210628 | A1 | 10/2004 | Inkinen et al. | |
| 2004/0216108 | A1 | 10/2004 | Robbin | |
| 2004/0224638 | A1 | 11/2004 | Fadell et al. | |
| 2004/0242224 | A1 | 12/2004 | Janik et al. | |
| 2004/0246275 | A1* | 12/2004 | Yoshihara et al. | 345/690 |
| 2004/0255135 | A1 | 12/2004 | Kitaya et al. | |
| 2004/0267825 | A1 | 12/2004 | Novak et al. | |
| 2005/0015254 | A1 | 1/2005 | Beaman | |
| 2005/0053365 | A1 | 3/2005 | Adams et al. | |
| 2005/0060240 | A1 | 3/2005 | Popofsky | |
| 2005/0060542 | A1 | 3/2005 | Risan et al. | |
| 2005/0108754 | A1 | 5/2005 | Carhart et al. | |
| 2005/0111820 | A1 | 5/2005 | Matsumi et al. | |
| 2005/0122315 | A1 | 6/2005 | Chalk et al. | |
| 2005/0123886 | A1 | 6/2005 | Hua et al. | |
| 2005/0146534 | A1 | 7/2005 | Fong et al. | |
| 2005/0149213 | A1 | 7/2005 | Guzak et al. | |
| 2005/0152294 | A1 | 7/2005 | Yu et al. | |
| 2005/0156047 | A1* | 7/2005 | Chiba et al. | 235/472.01 |
| 2005/0160270 | A1 | 7/2005 | Goldberg et al. | |
| 2005/0166153 | A1 | 7/2005 | Eytchison et al. | |
| 2005/0216855 | A1 | 9/2005 | Kopra et al. | |
| 2005/0218303 | A1* | 10/2005 | Poplin | 250/214 AL |
| 2005/0234983 | A1 | 10/2005 | Plastina et al. | |
| 2005/0245839 | A1 | 11/2005 | Stivoric et al. | |
| 2005/0246324 | A1 | 11/2005 | Paalasmaa et al. | |
| 2005/0248555 | A1 | 11/2005 | Feng et al. | |
| 2005/0257169 | A1* | 11/2005 | Tu | 715/810 |
| 2005/0259064 | A1* | 11/2005 | Sugino et al. | 345/102 |
| 2005/0259524 | A1 | 11/2005 | Yeh | |
| 2005/0270276 | A1 | 12/2005 | Sugimoto et al. | |
| 2006/0013414 | A1 | 1/2006 | Shih | |
| 2006/0025068 | A1 | 2/2006 | Regan et al. | |
| 2006/0026424 | A1 | 2/2006 | Eto | |
| 2006/0061563 | A1* | 3/2006 | Fleck | 345/211 |
| 2006/0068760 | A1 | 3/2006 | Hameed et al. | |
| 2006/0071899 | A1* | 4/2006 | Chang et al. | 345/102 |
| 2006/0088228 | A1 | 4/2006 | Marriott et al. | |
| 2006/0092122 | A1* | 5/2006 | Yoshihara et al. | 345/99 |
| 2006/0094409 | A1 | 5/2006 | Inselberg | |
| 2006/0095502 | A1 | 5/2006 | Lewis et al. | |
| 2006/0098320 | A1 | 5/2006 | Koga et al. | |
| 2006/0119613 | A1* | 6/2006 | Kerofsky | 345/590 |
| 2006/0135883 | A1 | 6/2006 | Jonsson et al. | |
| 2006/0145053 | A1* | 7/2006 | Stevenson et al. | 250/205 |
| 2006/0152382 | A1 | 7/2006 | Hiltunen | |
| 2006/0155914 | A1 | 7/2006 | Jobs et al. | |
| 2006/0170535 | A1 | 8/2006 | Watters et al. | |
| 2006/0173974 | A1 | 8/2006 | Tang | |
| 2006/0190577 | A1 | 8/2006 | Yamada | |
| 2006/0190980 | A1 | 8/2006 | Kikkoji et al. | |
| 2006/0221057 | A1 | 10/2006 | Fux et al. | |
| 2006/0221260 | A1* | 10/2006 | Fujine et al. | 348/790 |
| 2006/0221788 | A1 | 10/2006 | Lindahl et al. | |
| 2006/0259758 | A1 | 11/2006 | Deng et al. | |
| 2006/0265503 | A1 | 11/2006 | Jones et al. | |
| 2006/0272483 | A1 | 12/2006 | Honeywell | |
| 2006/0277336 | A1 | 12/2006 | Lu et al. | |
| 2007/0014536 | A1 | 1/2007 | Hellman | |
| 2007/0028009 | A1 | 2/2007 | Robbin et al. | |
| 2007/0061759 | A1 | 3/2007 | Klein | |
| 2007/0089057 | A1 | 4/2007 | Kindig | |
| 2007/0106660 | A1 | 5/2007 | Stern et al. | |
| 2007/0124679 | A1 | 5/2007 | Jeong et al. | |
| 2007/0129062 | A1 | 6/2007 | Pantalone et al. | |
| 2007/0135225 | A1 | 6/2007 | Nieminen et al. | |
| 2007/0248311 | A1* | 10/2007 | Wice et al. | 386/52 |
| 2007/0255163 | A1 | 11/2007 | Prineppi | |
| 2008/0055228 | A1* | 3/2008 | Glen | 345/102 |
| 2008/0134287 | A1 | 6/2008 | Gudorf et al. | |
| 2010/0077338 | A1 | 3/2010 | Matthews et al. | |

FOREIGN PATENT DOCUMENTS

| | | | |
|---|---|---|---|
| DE | 43 34 773 | A1 | 4/1994 |
| DE | 44 45 023 | A1 | 6/1996 |
| EP | 0 127 139 | | 5/1984 |
| EP | 0578604 | | 1/1994 |
| EP | 0 757 437 | | 2/1997 |
| EP | 0 813 138 | | 12/1997 |
| EP | 0 863 469 | | 9/1998 |
| EP | 0 917 077 | | 5/1999 |
| EP | 0 982 732 | | 3/2000 |
| EP | 1 028 425 | A2 | 8/2000 |
| EP | 1028426 | A2 | 8/2000 |
| EP | 1 076 302 | | 2/2001 |
| EP | 1107221 | | 6/2001 |
| EP | 1 213 643 | | 6/2002 |
| EP | 1 256 923 | | 11/2002 |
| EP | 1 289 197 | | 3/2003 |
| EP | 1 372 130 | | 12/2003 |
| EP | 1 372 133 | | 12/2003 |
| EP | 1 503 363 | | 2/2005 |
| EP | 1536612 | | 6/2005 |
| EP | 1 566 743 | | 8/2005 |
| EP | 1 569 423 | | 8/2005 |
| EP | 1566948 | | 8/2005 |
| EP | 1 372 133 | | 12/2005 |
| EP | 1 686 496 | | 8/2006 |
| GB | 2 370 208 | | 6/2002 |
| GB | 2384399 | | 7/2003 |
| GB | 2399639 | | 5/2005 |
| JP | 59-023610 | | 2/1984 |
| JP | 03-228490 | | 10/1991 |
| JP | 04-243386 | | 8/1992 |
| JP | 6-96520 | | 4/1994 |
| JP | 8-235774 | | 9/1996 |
| JP | 9-50676 | | 2/1997 |
| JP | 9-259532 | | 10/1997 |
| JP | 11 296338 | | 10/1999 |
| JP | 2000-90651 | | 3/2000 |
| JP | 2000-224099 | | 8/2000 |
| JP | 2000-285643 | | 10/2000 |
| JP | 2000-299834 | | 10/2000 |
| JP | 2000-311352 | | 11/2000 |
| JP | 2000-339864 | | 12/2000 |
| JP | 2001-236286 | | 8/2001 |
| JP | 2001-312338 | | 11/2001 |
| JP | 2002-076977 | | 3/2002 |
| JP | 2002-175467 | | 6/2002 |
| JP | 2003-188792 | | 7/2003 |
| JP | 2003-259333 | | 9/2003 |
| JP | 2003-319365 | | 11/2003 |
| JP | 2004-021720 | | 1/2004 |
| JP | 2004-219731 | | 8/2004 |
| JP | 2004-220420 | | 8/2004 |
| KR | 20010076508 | | 8/2001 |
| WO | WO 01/33569 | | 6/1995 |
| WO | WO 95/16950 | | 6/1995 |
| WO | 98/17032 | | 4/1998 |
| WO | WO 99/28813 | | 6/1999 |
| WO | WO 00/22820 | | 4/2000 |
| WO | WO 01/65413 | | 9/2001 |
| WO | WO 01/67753 | | 9/2001 |
| WO | WO 02/25610 | | 3/2002 |
| WO | WO 03/023786 | | 3/2003 |

| | | | |
|---|---|---|---|
| WO | WO 03/036457 | | 5/2003 |
| WO | WO 03/067202 | | 8/2003 |
| WO | 2004/061850 | A1 | 7/2004 |
| WO | WO 2004/055637 | | 7/2004 |
| WO | WO 2004/084413 | A2 | 9/2004 |
| WO | WO 2004/104815 | | 12/2004 |
| WO | WO 2005/031737 | | 4/2005 |
| WO | 2005/048644 | | 5/2005 |
| WO | WO 2005/008505 | | 7/2005 |
| WO | 2005/109781 | | 11/2005 |
| WO | WO 2006/040737 | | 4/2006 |
| WO | 2006/071364 | | 6/2006 |

OTHER PUBLICATIONS

International Search Report dated Dec. 5, 2007 in PCT Application No. PCT/US2007/004810.
International Search Report in Patent Application No. PCT/US2006/048738 dated Jan. 29, 2008.
International Search Report in Patent Application No. PCT/US2007/077020 dated Jan. 28, 2008.
International Search Report in Patent Application No. PCT/US2007/076889 dated Jan. 28, 2008.
iTunes, Wikipedia: The Free Encyclopedia; downloaded on Oct. 5, 2005, pp. 1-6.
Nutzel et al., "Sharing Systems for Future HiFi Systems", The Computer Society, Jun. 2004.
Partial Search Report dated Sep. 6, 2007 in PCT Application No. PCT/US2007/004810.
Written Opinion dated Dec. 5, 2007 in PCT Application No. PCT/US2007/004810.
Written Opinion in Patent Application No. PCT/US2006/048738 dated Jan. 29, 2008.
Written Opinion in Patent Application No. PCT/US2007/076889 dated Jan. 28, 2008.
Written Opinion in Patent Application No. PCT/US2007/077020 dated Jan. 28, 2008.
Office Action dated Feb. 1, 2008 in U.S. Appl. No. 11/327,544.
Hart-Daves, Guy. "How to Do Everything With Your iPod and iPod Mini", 2004, McGraw-Hill Professional, p. 33.
Office Action dated Feb. 4, 2008 in U.S. Appl. No. 11/566,072.
"Creative liefert erstes Portable Media Center aus" [Online] Sep. 2, 2004, Retrieved from the internet on Sep. 20, 2007 from http://www.golem.de/0409/33347.html>.
International Search Report dated Feb. 18, 2008 in Patent Application No. PCT/US2007/079766.
International Search Report Dated Sep. 27, 2007 in Application No. 05824296.7.
Office Action dated Apr. 4, 2008 in U.S. Appl. No. 11/212,555.
Office Action dated Feb. 20, 2008 in Japanese Application No. 2007-538196.
Office Action dated Feb. 25, 2008 in U.S. Appl. No. 11/749,599.
Office Action dated Mar. 4, 2008 from U.S. Appl. No. 10/973,657.
Partial International Search Report dated Feb. 1, 2008 in Patent Application No. PCT/US2007/010630.
Written Opinion dated Feb. 18, 2008 in Patent Application No. PCT/US2007/079766.
Search Report dated Mar. 20, 2008 in Patent Application No. PCT/US2007/077789.
Written Opinion dated Mar. 20, 2008 in Patent Application No. PCT/US2007/077789.
Invitation to Pay Additional Fees and Partial Search Report for PCT Application No. PCT/US2007/077160 dated Apr. 1, 2008.
"Combination Belt Clip Leaf Spring and Housing Latch", Wandt et al.; Motorola Technical Developments, Motorla Inc. Schaumburg, IL. vol. 18, Mar. 1, 1993.
Notification of Reason for Rejection from PCT Application No. 2003-539048 dated Nov. 27, 2007.
Kennedy, "Digital Data Storage Using Video Disc," IBM Technical Disclosure Bulletin, vol. 24, No. 2, Jul. 1981.
Nonhoff-Arps, et al., "Strassenmusik Portable MP3-Spieler mit USB-Anschluss," CT Magazin Fuer Computer Technik, Verlag Heinz Heise GMBH, Hannover DE, No. 25, Dec. 4, 2000.
"TAOS, Inc., Announces Industry's First Ambient Light Sensor to Convert Light Intensity to Digital Signals", www.taosinc.com/pressrelease_090902.htm, downloaded Jan. 23, 2003.
Bociurkiw, Michael, "Product Guide: Vanessa Matz,", www.forbes.com/asap/2000/1127/vmartz_print,html, Nov. 27, 2000.
"When it Comes to Selecting a Projection TV, Toshiba Makes Everything Perfectly Clear, Previews of New Releases", www.bestbuy.com/HomeAudioVideo/Specials/ToshibaTVFeatures.asp, downloaded Jan. 23, 2003.
"BL82 Series Backlit Keyboards", www.tg3electronics.com/products/backlit/backlit.htm, downloaded Dec. 19, 2002.
"12.1" 925 Candela Mobile PC", downloaded from LCDHardware.com on Dec. 19, 2002, http://www.lcdharware.com/pane1/12_1_panel/default.asp.
"Peripherals for Industrial Keyboards & Pointing Devices", Stealth Computer Corporation, downloaded on Dec. 19, 2002, http ://www.stealthcomputer.com/peropherals_oem.htm.
"Poly-Optical Fiber Optic Membrane Switch Backlighting", downloaded Dec. 19, 2002, http://www.poly-optical.com/membrane_switches.html.
"Public Safety Technologies Tracer 2000 Computer", downloaded Dec. 19, 2002, http://www.pst911.com/traver.html.
"Rocky Matrix Backlit Keyboard", downloaded Dec. 19, 2002, http://www.arnrel.com/asi_matrixkeyboard.html.
"Eluminx Illuminated Keyboard", downloaded Dec. 19, 2002, http://www.elumix.com/.
International Search Report dated Feb. 4, 2003 in corresponding application No. PCT/US2002/033330.
"Toughbook 28: Powerful, Rugged and Wireless", Panasonic: Toughbook Models, downloaded Dec. 19, 2002, http:www.panasonic.com/computer/notebook/html/01a_s8.htm.
"WhyBuy: Think Pad", IBM ThinkPad Web Page Ease of Use, downloaded on Dec. 19, 2002, http://www.pc.ibm.com/us/thinkpad/easeofuse.html.
"Creative Zen Vision: M 30GB", Dec. 21, 2005; downloaded on Jan. 11, 2008 from http://web.archive.org/web/20051221050140/http://www.everthingusb.com/creative_zen_vision:m_30gb.html>.
International Search Report dated Jul. 7, 2008 in PCT Application No. PCT/US2007/076793.
International Search Report dated Jun. 10, 2008 in PCT Application No. PCT/US2007/010630.
Kadir et al., "Adaptive Fast Playback-Based Video Skimming Using a Compressed-Domain Visual Complexity Measure", 2004 IEEE International Conference on Multimedia and Expo, pp. 2055-2058.
Office Action dated Jun. 17, 2008 in U.S. Appl. No. 11/212,313.
Office Action dated May 30, 2008 in Chinese Patent Application No. 02825938.6.
Office Action dated Oct. 16, 2008 in U.S. Appl. No. 11/327,544.
Office Action in Japanese Patent Application No. 2008-045351 dated Aug. 5, 2008.
Office Action in U.S. Appl. No. 11/212,555 dated Aug. 14, 2008.
Search Report dated May 15, 2008 in PCT Application No. PCT/US2007/019578.
Written Opinion dated Jul. 7, 2008 in PCT Application No. PCT/US2007/076793.
Written Opinion dated Jun. 10, 2008 in PCT Application No. PCT/US2007/010630.
Written Opinion dated May 15, 2008 in PCT Application No. PCT/US2007/019578.
Yee et al., "Faceted Metadata for Image Search and Browsing." Association for Computing Machinery, Conference Proceedings, Apr. 5, 2003.
"Apple Announces iTunes 2," Press Release, Apple Computer, Inc., Oct. 23, 2001.
"Apple Introduces iTunes / World's Best and Easiest to Use Jukebox Software," Macworld Expo, San Francisco, Jan. 9, 2001.
"Apple's iPod Available in Stores Tomorrow," Press Release, Apple Computer, Inc., Nov. 9, 2001.
"Nomad Jukebox," User Guide, Creative Technology Ltd., Version 1, Aug. 2000.
"SoundJam MP Plus Manual, version 2.0" / MP3 Player and Encoder for Macintosh by Jeffrey Robbin, Bill Kincaid and Dave Heller, manual by Tom Negrino, published by Casady & Greene, Inc., 2000.

"Bluetooth PC Headsets—Enjoy Wireless VoIP Conversations: 'Connecting' Your Bluetooth Headset With Your Computer", Bluetooth PC Headsets; downloaded on Apr. 29, 2006 from http://www.bluetoothpcheadsets.com/connect.htm.
"Creative MuVo TX 256 MB," T3 Magazine, Aug. 17, 2004, http://www.t3.co.uk/reviews/entertainment/mp3_player/creative_muvo_tx_256mb [downloaded Jun. 6, 2006].
"Digital Still Cameras—Downloading Images to a Computer," Mimi Chakarova et al., Multi/Media Reporting and Convergence, 2 pgs.
"How to Pair a Bluetooth Headset & Cell Phone", About.com; downloaded on Apr. 29, 2006 from http://mobileoffice.about.com/od/usingyourphone/ht/blueheadset_p.htm.
"QuickTime Movie Playback Programming Guide", Apple Computer, Inc., Aug. 11, 2005.
"QuickTime Overview", Apple Computer, Inc., Aug. 11, 2005.
"Sony Ericsson to introduce Auto pairing to improve Bluetooth connectivity between headsets and phones", Sep. 28, 2005 Press Release, Sony Ericsson Corporate; downloaded on Apr. 29, 2006 from http://www.sonyericsson.com/spg.j sp?cc=global&lc=en&ver=4001 &template=pc3_1_1 &z....
512MB Waterproof MP3 Player with FM Radio & Built/in Pedometer, Oregon Scientific, downloaded on Jul. 31, 2006 from http://www2.oregonscientific.com/shop/product.asp?cid=4&scid=11 &pid=581.
Adam C. Engst, "SoundJam Keeps on Jammin'," Jun. 19, 2000, http://db.tidbits.com/getbits.acgi?tbart=05988.
Alex Veiga, "AT&T Wireless Launching Music Service," Yahoo! Finance, Oct. 5, 2004, pp. 1/2.
Andrew Birrell, "Personal Jukebox (PJB)," Oct. 13, 2000, http://birrell.org/andrew/talks/pjb/overview.ppt.
Apple iPod Technical Specifications, iPod 20GB and 60GB Mac + PC, downloaded from http://www.apple.com/ipod/color/specs.html on Aug. 8, 2005.
Compaq, "Personal Jukebox," Jan. 24, 2001 http://research.compaq.com/SRC/pjb/.
Creative: "Creative NOMAD MuVo TX," www.creative.com, Nov. 1, 2004, http://web.archive.org/web/20041024175952/www.creative.com/products/pfriendly.asp?product=9672 [downloaded Jun. 6, 2006].
Creative: "Creative NOMAD MuVo," www.creative.com, Nov. 1, 2004, http://web.archive.org/web/20041024075901/www.creative.com/products/product.asp?category=213&subcategory=215&product=110 [downloaded Jun. 7, 2006].
Creative: "MP3 Player," www.creative.com, Nov. 1, 2004, http://web.archive.org/web/20041024074823/www.creative.com/products/product.asp?category=213&subcategory=216&product=4983 [downloaded Jun. 7, 2006].
De Herrera, Chris, "Microsoft ActiveSync 3.1," Version 1.02, Oct. 13, 2000.
iAP Sports Lingo 0x09 Protocol V1.00, May 1, 2006.
IEEE 1394—Wikipedia, 1995, http://www.wikipedia.org/wiki/Firewire.
Written Opinion of the International Searching Authority dated Nov. 24, 2006 in PCT Application No. PCT/US2005/046797.
International Search Report dated Jul. 10, 2007 in corresponding application No. PCT/US2006/048738.
International Search Report dated Apr. 5, 2006 from corresponding International Application No. PCT/US2005/038819.
International Search Report dated Jul. 2, 2007 in related case PCT/US2006/048669.
International Search Report dated Jun. 19, 2007 in related Application PCT/US2006/048753.
International Search Report dated May 21, 2007 from corresponding PCT Application No. PCT/US2006/048670.
International Search Report in corresponding European Application No. 06256215.2 dated Feb. 20, 2007.
Invitation to Pay Additional Fees and Partial Search Report for corresponding PCT Application No. PCT/US2005/046797 dated Jul. 3, 2006.
iTunes 2, Playlist Related Help Screens, iTunes v2.0, Apple Computer, Inc., Oct. 23, 2001.
iTunes, Playlist Related Help Screens, iTunes v1.0, Apple Computer, Inc., Jan. 2001.
Jabra Bluetooth Headset User Manual; GN Netcom A/s, 2005.
Jabra Bluetooth Introduction; GN Netcom A/S, Oct. 2004.
Jabra FreeSpeak BT200 User Manual; Jabra Corporation, 2002.
Miniman, "Applian Software's Replay Radio and Player v1.02," Product review, pocketnow.com, http://www.pocketnow.com/reviews/replay/replay.htm, Jul. 31, 2001.
Musicmatch, "Musicmatch and Xing Technology Introduce Musicmatch Jukebox," May 18, 1998, http://www.musicmatch.com/info/company/press/releases/?year=1998&release=2.
International Search Report dated Nov. 24, 2006 in PCT Application No. PCT/US2005/046797.
Personal Jukebox (PJB), "Systems Research Center and PAAD," Compaq Computer Corp., Oct. 13, 2000, http://research.compaq.com/SRC/pjb/.
Peter Lewis, "Two New Ways to Buy Your Bits," CNN Money, Dec. 31, 2003, pp. 1/4.
Sastry, Ravindra Wadali. "A Need for Speed: A New Speedometer for Runners", submitted to the Department of Electrical Engineering and Computer Science at the Massachusetts Institute of Technology, May 28, 1999.
Sinitsyn, Alexander. "A Synchronization Framework for Personal Mobile Servers," Pervasice Computing and Communications Workshops, 2004. Proceedings of the Second IEEE Annual Conference on, Piscataway, NJ, USA, IEEE, Mar. 14, 2004, pp. 208/212.
SoundJam MP Plus, Representative Screens, published by Casady & Greene, Inc., Salinas, CA, 2000.
Specification Sheet, iTunes 2, Apple Computer, Inc., Oct. 31, 2001.
Spiller, Karen. "Low/decibel earbuds keep noise at a reasonable level", The Telegraph Online, dated Aug. 13, 2006, http://www.nashuatelegraph.com/apps/pbcs.dll/article?Date=20060813&Cate.. Downloaded Aug. 16, 2006.
Steinberg, "Sonicblue Rio Car," Product Review, Dec. 12, 2000, http://electronics.cnet.com/electronics/0/6342420/1304/4098389.html.
Travis Butler, "Archos Jukebox 6000 Challenges Nomad Jukebox," Aug. 13, 2001, http://db.tidbits.com/getbits.acgi?tbart=06521.
Travis Butler, "Portable MP3: The Nomad Jukebox," Jan. 8, 2001, http://db.tidbits.com/getbits.acgi?tbart=06261.
U.S. Appl. No. 11/621,541, "Personalized Podcasting Podmapping" filed Jan. 9, 2007.
Waterproof Music Player with FM Radio and Pedometer User Manual, Oregon Scientific, 2005.
Office Action dated Jun. 2, 2009 in U.S. Appl. No. 11/530,773.
Office Action dated May 11, 2009 in U.S. Appl. No. 11/680,580.
Notice of Allowance dated Apr. 21, 2009 in U.S. Appl. No. 11/327,544.
Office Action in European Patent Application No. 05 855 368.6 dated Nov. 20, 2008.
Office Action dated Dec. 15, 2008 in U.S. Appl. No. 11/212,313.
Notice of Allowance dated Dec. 18, 2008 in U.S. Appl. No. 11/212,555.
International Search Report dated Oct. 10, 2008 in PCT Application No. PCT/US2007/077160.
Written Opinion dated Oct. 10, 2008 in PCT Application No. PCT/US2007/077160.
Office Action dated Jan. 26, 2009 in U.S. Appl. No. 11/373,468.
Office Action dated Sep. 1, 2008 in EP Application No. 06 256 215.2.
Written Opinion dated Jan. 6, 2009 in Singapore Application No. 200701865-8.
Office Action dated Mar. 30, 2009 in U.S. Appl. No. 11/515,270.
Office Action dated Apr. 9, 2009 in U.S. Appl. No. 11/583,199.
Notice of Allowance dated Jun. 15, 2009 in U.S. Appl. No. 11/212,313.
Office Action dated Jun. 24, 2009 in U.S. Appl. No. 11/373,468.
Office Action dated Jun. 22, 2009 in U.S. Appl. No. 11/515,270.
Office Action dated Jun. 24, 2009 in U.S. Appl. No. 11/519,352.
Office Action dated May 29, 2009 in EP Application No. 06 847 856.9.
Office Action dated Sep. 2, 2009 in U.S. Appl. No. 11/515,270.
Office Action dated Sep. 3, 2009 in U.S. Appl. No. 11/324,863.
Office Action dated Sep. 10, 2009 in U.S. Appl. No. 11/746,548.
Office Action dated Oct. 16, 2009 in U.S. Appl. No. 11/583,199.

Office Action dated Oct. 23, 2009 in Chinese Application No. 200580048143.9.
Office Action dated Nov. 16, 2009 in U.S. Appl. No. 11/144,541.
Office Action dated Mar. 24, 2010 in U.S. Appl. No. 11/583,199.
Office Action dated Mar. 25, 2010 in U.S. Appl. No. 11/297,032.
Office Action dated Mar. 10, 2010 in U.S. Appl. No. 11/583,327.
Office Action dated Mar. 11, 2010 in U.S. Appl. No. 11/830,746.
Office Action dated Mar. 4, 2010 in U.S. Appl. No. 11/324,863.
Examination Report dated Sep. 1, 2009 in Singapore Application No. 200701865-8.
Office Action dated Sep. 25, 2009 in Chinese Application No. 200610130904.1.
Notice of Allowance dated Feb. 4, 2010 in U.S. Appl. No. 11/535,646.
Office Action dated Apr. 12, 2010 in U.S. Appl. No. 12/397,051.
Office Action dated Apr. 13, 2010 in U.S. Appl. No. 12/406,793.
Office Action dated Apr. 15, 2010 in U.S. Appl. No. 11/373,468.
Chinese Office Action dated Jun. 4, 2010 from Chinese Application No. 200780025550.7.
Office Action in corresponding Korean Application No. 10-2008-7031095, mailed May 4, 2010.
European Search Report in EP Application No. 10177144.2, mailed Nov. 5, 2011.
Office Action dated Oct. 29, 2010 in U.S. Appl. No. 12/535,564.
European Office Action dated Mar. 21, 2011 for European Patent Application No. 07 776 609.5.
European Office Action dated Mar. 15, 2011 for European Patent Application No. 10 177 144.2.
Notice of Allowance dated Jun. 23, 2011 in U.S. Appl. No. 12/535,564.
Office Action dated Mar. 28, 2011 in U.S. Appl. No. 12/535,564.
Office Action dated Mar. 15, 2011 in EP Application No. 10 177 144.2.
Office Action dated Mar. 21, 2011 in EP Application No. 07 776 609.5.
Office Action dated Nov. 30, 2011 from Chinese Patent Application No. 200780025550.7.
Office Action dated Nov. 29, 2010 from Korean Patent Application No. 10-2008-7031095.
Office Action dated May 4, 2010 from Korean Patent Application No. 10-2008-7031095.
Notice of Allowance and Allowed Claims dated Mar. 1, 2012, in Chinese Patent Application No. 200780025550.7.
Decision to Refuse a European Patent Application dated Feb. 16, 2012, in European Patent Application No. 07776609.5.
Decision to Refuse a European Patent Application dated Feb. 16, 2012, in European Patent Application No. 10177144.2.
Search Report dated Jun. 18, 2012 in European Patent Application No. 12165676.3.
Office Action in corresponding EP application No. 07776609.5, dated Nov. 2, 2010.

* cited by examiner

PORTABLE MEDIA DEVICE WITH POWER-MANAGED DISPLAY

CROSS-REFERENCE TO RELATED APPLICATIONS

This application is related to (i) U.S. application Ser. No. 10/118,217, filed Apr. 5, 2002, and entitled "MEDIA PLAYER WITH INSTANT PLAY CAPABILITY," which is hereby incorporated herein by reference; (ii) U.S. application Ser. No. 11/131,800, filed May 17, 2005, and entitled "MEDIA PLAYER WITH INSTANT PLAY CAPABILITY," which is hereby incorporated herein by reference; and (iii) U.S. application Ser. No. 10/402,311, filed Mar. 26, 2003, and entitled "COMPUTER LIGHT ADJUSTMENT," which is hereby incorporated herein by reference.

BACKGROUND OF THE INVENTION

1. Field of the Invention

The invention relates to media devices and, more particularly, to portable media devices having displays.

2. Description of the Related Art

Portable media devices, such as MP3 players, video players, cell phones, and PDAs, are typically small, lightweight and highly portable. The primary source of power to these media devices are rechargeable batteries housed within the media devices. These batteries are typically recharged through a cable that connects to an AC adapter or a peripheral port of a personal computer. A portable media device typically includes a display that presents a user interface to a user of the device. The user interface can assist with user control or navigation of the media device as well as displaying information pertaining to media being played. For example, as to user control or navigation, the display can display menus or lists, volume level, user preferences, playback status, etc. As another example, when an audio item (e.g., song) is being played by the media device, the title and possibly the artwork associated with the song (or its associated album) can be displayed on the display. As still another example, when a video item (e.g., movie) is being played by the media device, video frames can be sequentially displayed on the display.

Some portable media devices dim or turn-off their displays when not being used. Dimming or deactivating a display serves to reduce its power consumption. For example, a display might be dimmed or turned-off after a lack of any user interaction for a period of time. As another example, when a housing (e.g., clam shell type cell phone housing or laptop computer housing) is closed, its display is typically turned off since it is no longer usable by the user.

Nevertheless, there is an increasing demand for larger and brighter displays on portable media devices. Unfortunately, however, the increased power consumption of larger and brighter displays leads to substantial increases in the overall power consumption of the portable media devices. Accordingly, larger and brighter displays increase the demand for power from the batteries. As a result, portable media devices may need to provide larger, heavier batteries in order to power the larger and brighter displays for a sufficient duration of time. The conventional approaches to dimming or deactivating displays are not able to address the power consumption difficulties due to the larger and brighter displays.

Thus, there remains a need for improved techniques to intelligently manage power consumption of portable media devices.

SUMMARY OF THE INVENTION

The invention relates to improved techniques for controlling power utilization of a display device so as to reduce power consumption. The improved techniques reduce power consumption by lowering display intensity at appropriate times. In one embodiment, the display intensity can be controlled depending on the type of content being displayed. For example, when displaying certain types of content, the display intensity can be lowered from its otherwise high, constant intensity level. In another embodiment, the display intensity can be controlled depending on the characteristics of the content being displayed. For example, when displaying images that are light, the display intensity can be lowered from its otherwise high, constant intensity level. In still another embodiment, the display intensity can be controlled depending on the type and characteristics of content being displayed.

The invention is well suited for use with portable media devices. The portable media devices can, for example, be battery-powered media playback devices. The battery-powered media playback devices can be highly portable, such as handheld or pocket-sized media players.

The invention can be implemented in numerous ways, including as a method, system, device, apparatus, or computer readable medium. Several embodiments of the invention are discussed below.

As a method for controlling display intensity of a display device of a portable electronic device, one embodiment of the invention includes at least the acts of: identifying content being displayed or to be displayed on the display device, the content having a content type associated therewith; determining the content type of the identified content; and setting an output intensity for the display device based on the determined content type.

As a method for controlling brightness of a display device of a portable electronic device, another embodiment of the invention includes at least the acts of: identifying content to be displayed on the display device, the content having a content type associated therewith; determining the content type of the identified content; obtaining a user preference associated with the content type; and setting a brightness level for the display device based on at least one of the determined content type and the user preference.

As a method for controlling display intensity of a display device of a battery-powered electronic device, the electronic device also having a user input device, one embodiment of the invention includes at least the acts of: receiving a user input via the user input device; determining content to be displayed in response to the received user input; determining a content type for the content to be displayed; establishing a display intensity for the display device based on the content type; activating the display device if not already activated; displaying the content on the display device in accordance with the display intensity; and subsequently deactivating the display device if a subsequent user input is not received within a predetermined period of time after the received user input was received.

As a method for controlling display intensity of a display device of a portable electronic device, still another embodiment of the invention includes at least the acts of: identifying content to be displayed on the display device, the content having at least one content characteristic associated therewith; determining at least one content characteristic of the identified content; and setting an output intensity level for the display device based on the at least one determined content characteristic.

As a computer readable medium including at least computer program code for displaying content on a display of a portable electronic device in a power efficient manner, one embodiment of the invention includes at least: computer program code for identifying content being displayed or to be displayed on the display, the content having a content type associated therewith; computer program code for determining the content type of the identified content; computer program code for setting an output intensity for the display based on the determined content type; and computer program code for displaying the content on the display in accordance with the output intensity level that has been set.

As a computer readable medium including at least computer program code for displaying content on a display of a portable electronic device in a power efficient manner, another embodiment of the invention includes at least: computer program code for identifying content to be displayed on the display, the content having a content type and at least one content characteristic associated therewith; computer program code for determining the content type and at least one content characteristic of the identified content; computer program code for setting an output intensity level for the display based on the determined content type and the at least one determined content characteristic; and computer program code for displaying the content on the display in accordance with the output intensity level that has been set.

As a portable media device, one embodiment of the invention includes at least: a rechargeable battery that provides power to the portable media device; a media store that stores media files pertaining to media items, the media files include at least media content for the media items; a display device; and a processor capable of processing a media file from the media store and producing media output signals for controlling the display device, wherein at least one of the media output signals controls display intensity of the display device based on the media item associated with the media file.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to improved techniques for controlling power utilization of a display device so as to reduce power consumption. The improved techniques reduce power consumption by lowering display intensity at appropriate times. In one embodiment, the display intensity can be controlled depending on the type of content being displayed. For example, when displaying certain types of content, the display intensity can be lowered from its otherwise high, constant intensity level. In another embodiment, the display intensity can be controlled depending on the characteristics of the content being displayed. For example, when displaying images that are light, the display intensity can be lowered from its otherwise high, constant intensity level. In still another embodiment, the display intensity can be controlled depending on the type and characteristics of content being displayed.

The invention is well suited for use with portable media devices. The portable media devices can, for example, be battery-powered media playback devices. The battery-powered media playback devices can be highly portable, such as handheld or pocket-sized media players. Examples of portable media device include media players (e.g., MP3 players or video players), cell phones having media support, and PDAs.

Embodiments of the invention are discussed below with reference to FIGS. 1-6. However, those skilled in the art will readily appreciate that the detailed description given herein with respect to these figures is for explanatory purposes as the invention extends beyond these limited embodiments.

Figure 1:
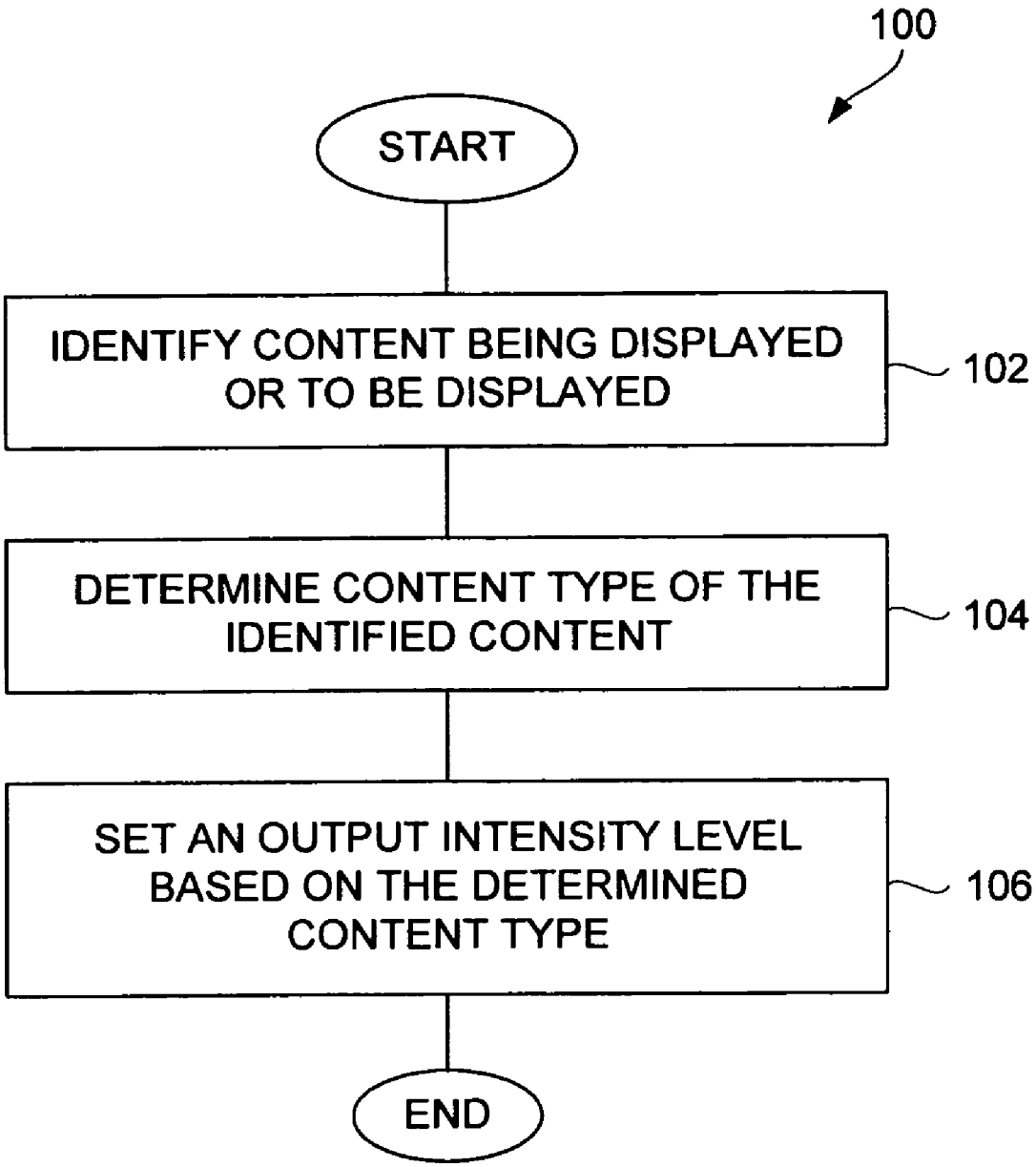
FIG. 1 is a flow diagram of an intensity control process according to one embodiment of the invention.

FIG. 1 is a flow diagram of an intensity control process 100 according to one embodiment of the invention. The intensity control process 100 is suitable for controlling an output intensity for a display device in a power efficient manner. The intensity control process 100 is, for example, performed by a media device when operating to control an output intensity of a display device associated with the media device.

The intensity control process 100 initially identifies 102 content being displayed or to be displayed on a display device. The content type of the identified content can then be determined 104. Examples of content type include text, photos or video. After the content type has been determined, an output intensity level for the display device can be set 106 based on the determined content type. Following the block 106, the intensity control process 100 is complete and ends. In this embodiment, the output intensity level for the display device is controlled based on the content type of content that is currently being displayed, was recently displayed, or will soon be displayed.

The advantage of controlling the output intensity level, in accordance with any of the embodiments described herein, is that the output intensity level can be intelligently lowered when appropriate so that the power consumption of the display device is reduced. By lowering the power consumption of the display device, the media device utilizing the display device operates in a more power efficient manner such that the battery that supplies power to the media device can power the media device for a longer duration.

Figure 2:
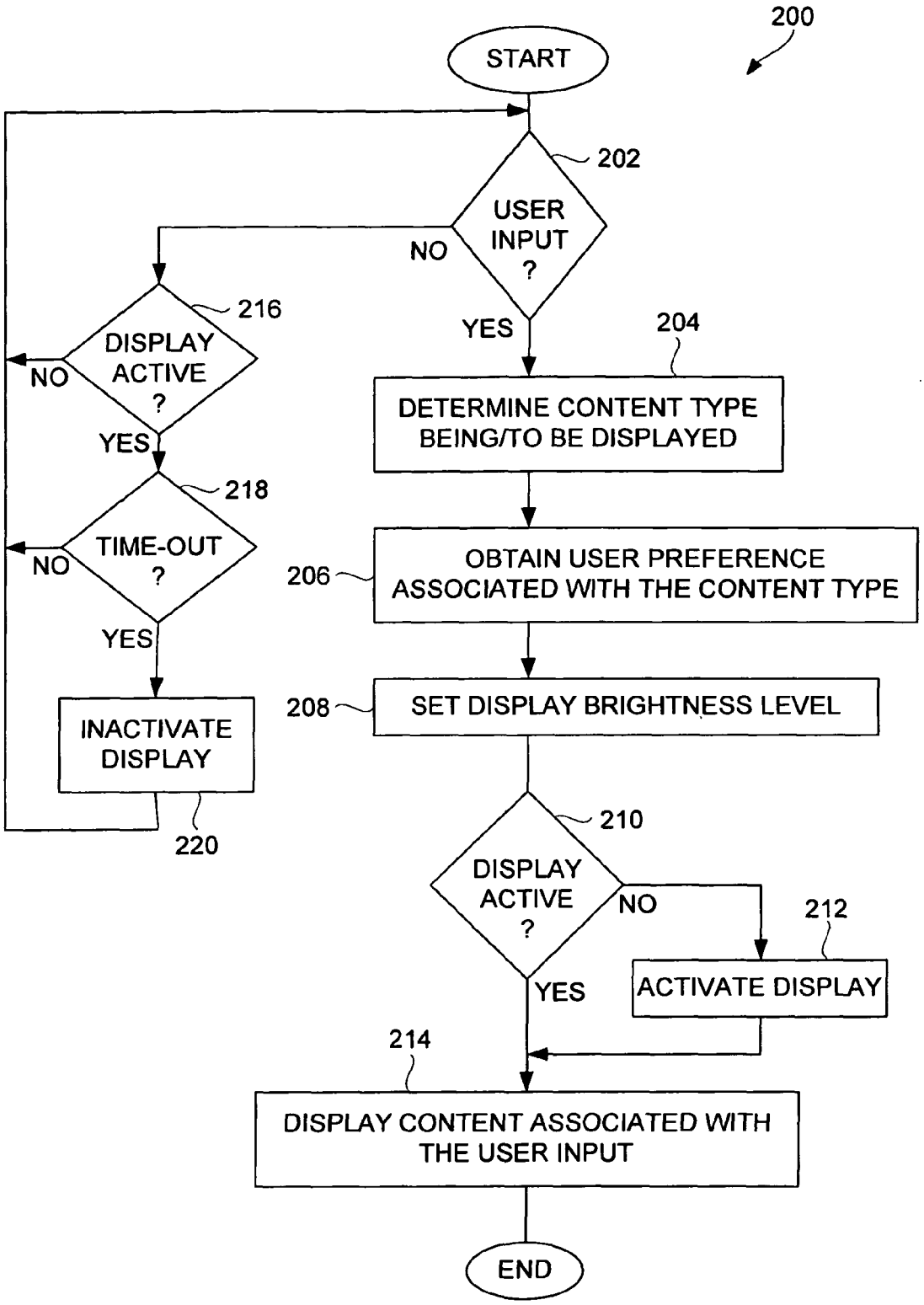
FIG. 2 is a flow diagram of a display activation/deactivation process according to one embodiment of the invention.

FIG. 2 is a flow diagram of a display activation/deactivation process 200 according to one embodiment of the invention. The display activation/deactivation process 200 is, for example, performed by a media device having a user input device and a display device.

The display activation/deactivation process 200 begins with a decision 202. The decision 202 determines whether a user input has been received. For example, a user of the media device can interact with the user input device to provide a user input to the media device. When the decision 202 determines that a user input has been received, it is assumed that the user input is identifying content to be displayed. Hence, a content type for the content to be displayed is determined 204. Typically, the content to be displayed has a single content type, such as text, image or video. However, if the content to be displayed has multiple content types, then a primary or dominant content type can be used. In another embodiment, a content type can be associated with mixed content types (e.g., mixed text and images).

In addition, a user preference associated with the content type can be obtained 206. In some cases, a user may not have provided a user preference associated with the content type, in such cases, either a default user preference or no user preference can be utilized. Next, a display brightness level for the display device is set 208. In one embodiment, the display brightness level is set 208 based on one or both of the content type and the user preference.

Next, a decision 210 determines whether the display device is active. When the decision 210 determines that the display device is not active, the display device is activated 212. Following the block 212 or directly following the decision 210 when the display device is active, the content associated with the user input is displayed 214. The content is thus displayed 214 in accordance with the display brightness level that has been set 208. For example, if the display device uses a backlight, the activation of the display device can cause the backlight to be turned on or turned upward/downward to a brightness associated with the display brightness level.

Following the block 214, the display activation/deactivation process 200 ends. However, it should be noted that upon receiving a subsequent user input, the display activation/deactivation process 200 can be repeated.

On the other hand, when the decision 202 determines that a user input has not been received, additional processing can be performed to cause the display device to be inactivated when not being utilized. By inactivating the display device when not being utilized, the power consumption by the display device can be reduced. In this regard, a decision 216 determines whether the display device is active. When the decision 216 determines that the display device is active, a decision 218 determines whether a time-out has occurred. The time-out is associated with a predetermined period of time following the last user input. Hence, a time-out timer can be utilized to determine whether there has been no activity with respect to user inputs for the predetermined period of time. The predetermined period of time can vary widely with application. As one example, the predetermined period of time can be 10 seconds. When the decision 218 determines that a time-out has occurred (i.e., inactivity for the predetermined period of time), then the display device is inactivated 220. For example, if the display device uses a backlight, the inactivation of the display can cause the backlight to be turned downward to a lower display brightness level or be completely turned off. Following the block 220, as well as following the decision 216 when the display device is not active or following the decision 218 when a time-out has not occurred, the display activation/deactivation process 200 can return to repeat the decision 202 and subsequent blocks so that other incoming user inputs can be processed.

Figure 3:
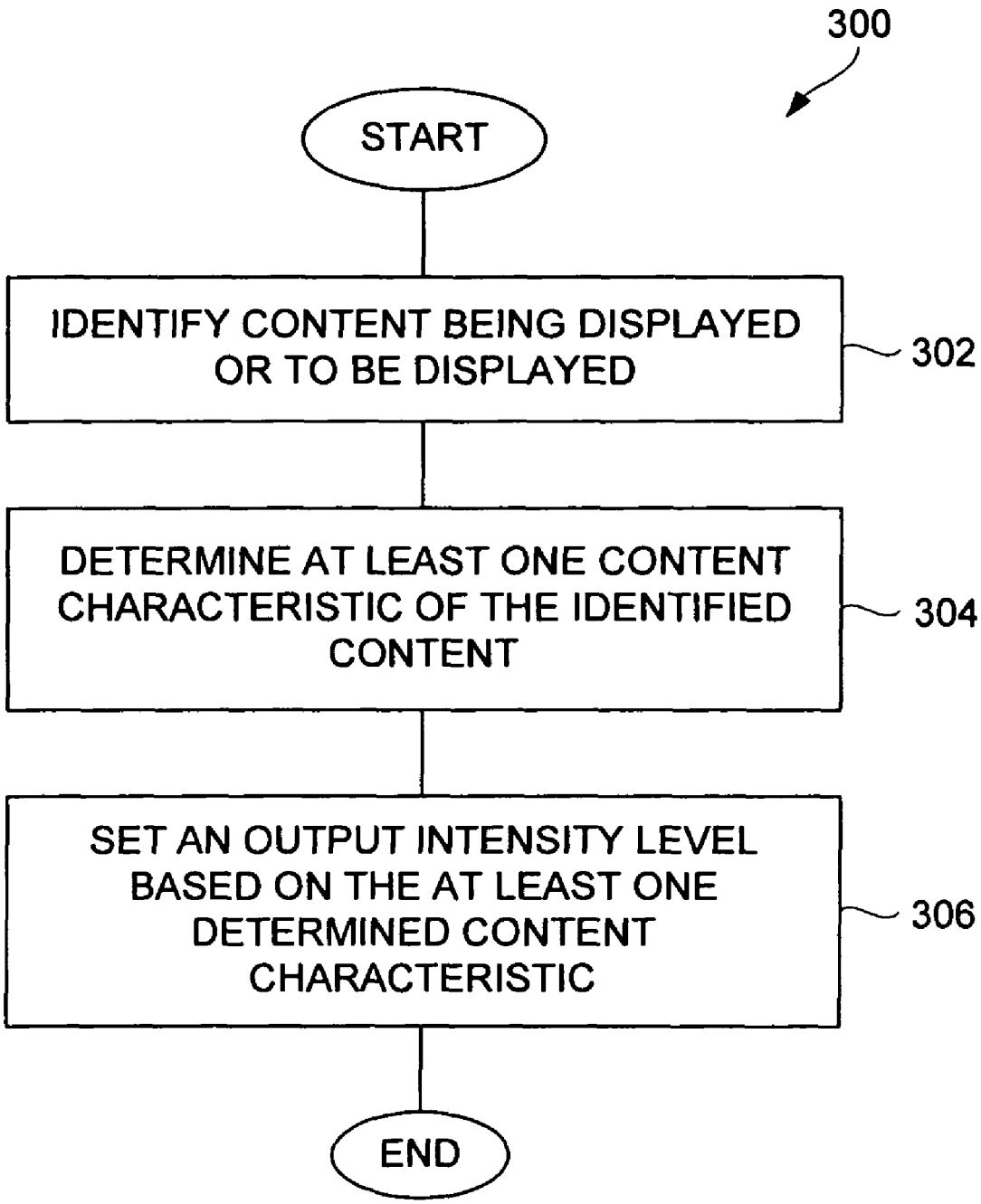
FIG. 3 is a flow diagram of an intensity control process according to another embodiment of the invention.

FIG. 3 is a flow diagram of an intensity control process 300 according to another embodiment of the invention. The intensity control process 300 is suitable for controlling an output intensity for a display device in a power efficient manner. The intensity control process 300 is, for example, performed by a media device when operating to control an output intensity of a display device associated with the media device.

The intensity control process 300 initially identifies 302 content being displayed or to be displayed on the display device. Then, at least one content characteristic of the identified content is determined 304. For example, the content characteristics can include brightness, contrast or color of the content. The color of the content can pertain to the color itself or color characteristics such as absolute or relative color. Then, an output intensity level can be set 306 based on the at least one determined content characteristic. Following the block 306, the intensity control process 300 is complete and ends.

In general, intensity control can make use of one or both of content type and characteristics of the content. Hence, in one embodiment, the intensity control process 300 and the intensity control process 100 can be combined. In such an embodiment, the output intensity level can be set based on content type and at least one content characteristic.

Figure 4:
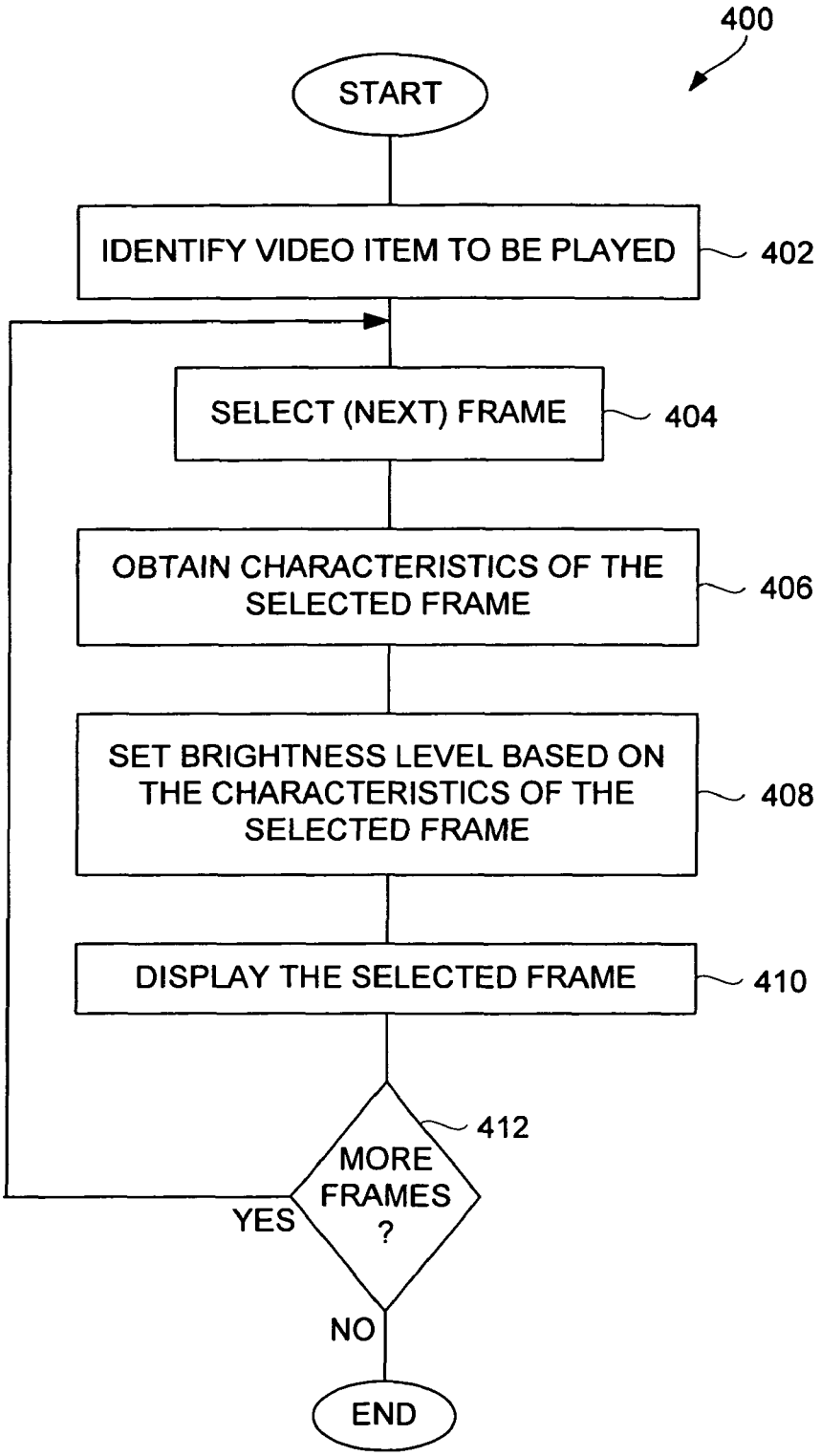
FIG. 4 is a flow diagram of a video display process according to one embodiment of the invention.

FIG. 4 is a flow diagram of a video display process 400 according to one embodiment of the invention. The video display process 400 is performed by a media device while presenting (e.g., displaying) video content on a display device.

The video display process 400 initially identifies 402 a video item to be played. After the video item to be played has been identified 402, a frame of the video item is selected 404. One or more characteristics of the selected frame are then obtained 406. Here, the characteristics can, for example, include lightness, darkness, contrast, and color. The brightness level for the display device can then be set 408 based on the characteristics of the selected frame. In one embodiment, a controller (e.g., a graphics controller) is aware of the characteristics of a frame that is being output to a display device, and thus can operate to set the brightness level for the display device in view of the characteristics of the selected frame. After the brightness level is set 408, the selected frame is then displayed 410 in accordance with the brightness level.

Following the block 410, a decision 412 determines whether there are more frames of the video item to be processed. When the decision 412 determines that there are more frames of the video item to be displayed, the video display process 400 returns to repeat the block 404 so that a next frame can be selected and similarly processed. On the other hand, when the decision 412 determines that there are no more frames of the video item to be displayed, then the video display process 400 is complete and ends.

In general, brightness control can be determined or influenced by one or more of user preferences, content type, content characteristics, power source, ambient light conditions, brightness, contrast, degree image is dynamic, and display type.

Figure 5A:
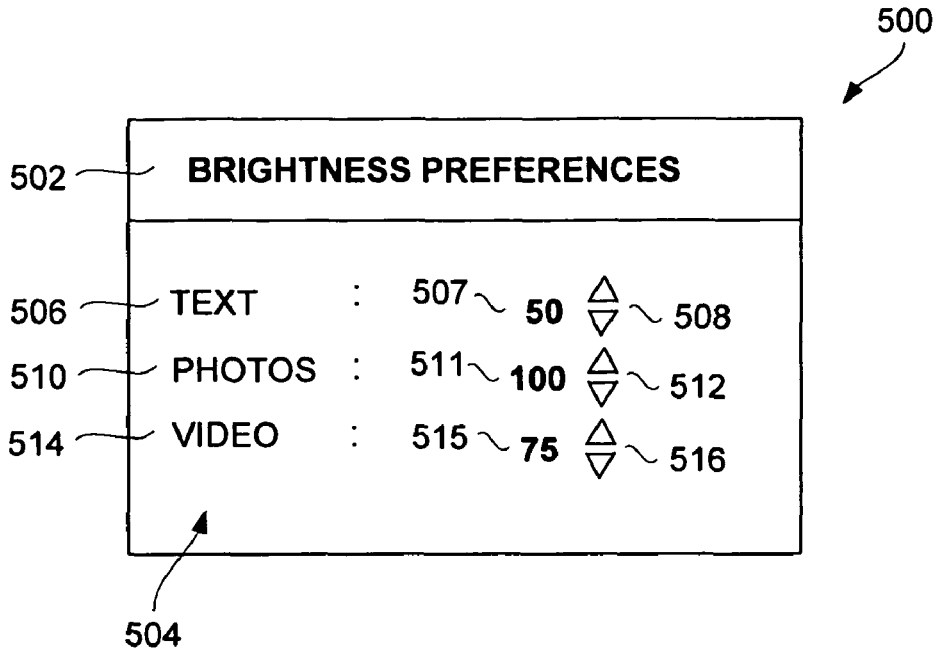
FIGS. 5A, 5B and 5C are representative user preference windows according to embodiments of the invention.
Figure 5B:
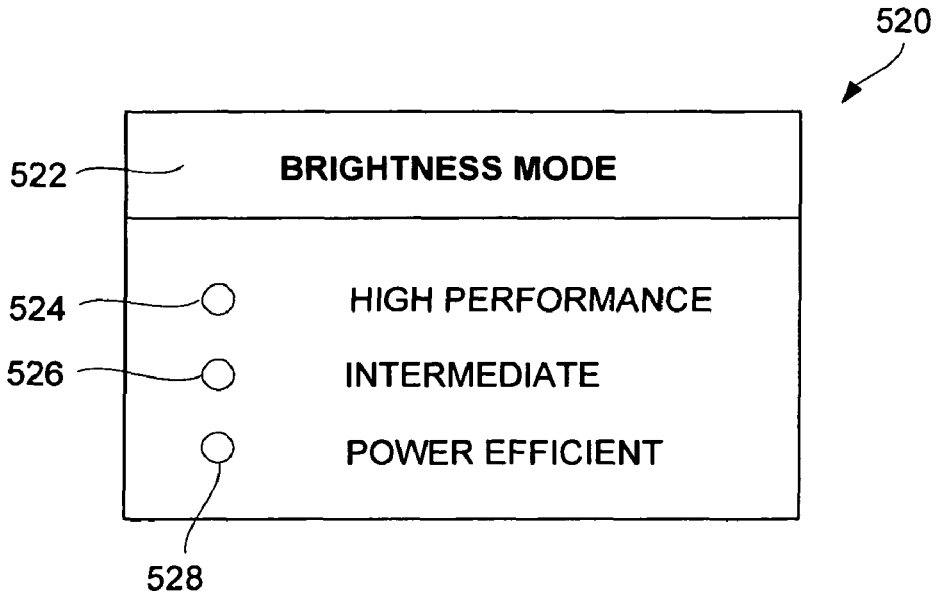
Figure 5C:
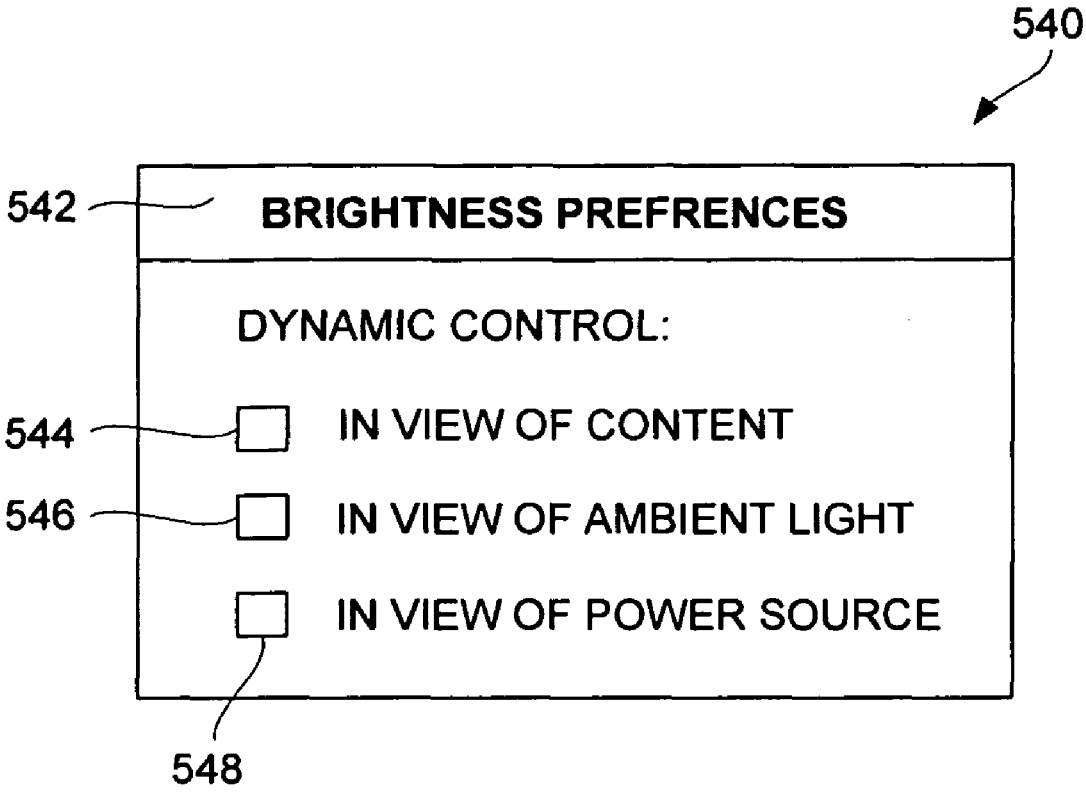

FIGS. 5A, 5B and 5C are representative user preference windows according to embodiments of the invention. One or more user preference windows can be presented on a display device to assist a user in setting user preferences. In particular, these user preference windows assist a user in setting brightness preferences for the display device. In particular, FIG. 5A illustrates a user preference window 500 that enables a user to set brightness preferences. The user preference window 500 includes a window label (or title) 502 that designates the window as pertaining to "Brightness Preferences". Within the user preference window 500, the brightness preference can be independently provided for each of text, photos and video. In other words, a brightness preference can be separately set for different content types. Specifically, text 506 can have a user brightness preference 507 set by user controls 508. In this example, the user controls 508 allow the user to increment or decrement the user brightness preference 507. In this example, the user brightness preference reflects a percentage of a maximum brightness. For example, when the user brightness preference is "50", the user brightness preference is requesting brightness for text to be at 50% of maximum brightness. In addition, photos 510 can have a user brightness preference 511 set through use of user controls 512, and video 514 can have a user preference 515 set through use of user controls 516.

FIG. 5B illustrates a user preference window 520 that enables a user to set brightness preferences. In this example, the brightness preferences are established by selection of a brightness mode. In FIG. 5B, a user preference window 520 includes a window label 522 that designates the window as pertaining to "Brightness Mode". In this example, there are three different available brightness modes: (i) high performance, (ii) intermediate and (iii) power efficient. Through use of control buttons 524, 526 and 528, a user can respectively select one of the available brightness modes to be utilized in controlling a display device. Each of these different modes can control the display brightness differently. These different modes can control brightness in general and/or can control brightness depending upon the type of content being displayed or depending on the characteristics of the content being displayed.

FIG. 5C illustrates a user preference window 540 that enables a user to set brightness preferences. The user preference window 540 includes a window label (or title) 542 that designates the window as pertaining to "Brightness Preferences". The user preference window 540 allows the user to determine the type of dynamic brightness control to be utilized. For example, the brightness control can be dynamic in view of content, ambient light or power source. Through check boxes 544, 546 and 548, a user can select one or more of the different types of dynamic control. When the checkbox 544 is selected, the brightness of the display device can be dynamically controlled in view of the content (e.g., content type and/or characteristics) being displayed. When the checkbox 546 is checked, the brightness of the display device can be dynamically controlled in view of ambient light in the vicinity of the media device. When the checkbox 548 is selected, the brightness of the display device can be dynamically controlled in view of the available power source. For example, the brightness can be different depending upon whether the media device is operating under battery power or connected to an AC power source. Besides content, ambient light or power source, other user preferences can be used to determine the type of dynamic brightness control to be utilized.

The characteristics for content can be acquired in a variety of different ways. One way is to inspect each image to be displayed. Another way is to inspect several images, such as stored in a buffer. This would facilitate performing calculations on past, current and upcoming images.

When the content type or the characteristics of content are being utilized to alter the brightness while the media is being displayed, the determination of content type or content characteristics can be determined in real time or can be determined at a slower pace. For example, when displaying video at thirty (30) frames per second, not every frame needs to be examined to determine the appropriate content type or content characteristics. For example, content type tends to be the same depending upon the type of media item being selected. Also, content characteristics tend not to change that rapidly in the case of video frames. For example, it may be suitable to examine every $2^{nd}$, $5^{th}$ or $10^{th}$ frame and adjust the brightness based on such examination.

Further, the content whose characteristics are being monitored can pertain to a current frame, a prior frame or a subsequent frame, or even some combination thereof. One example of a combination would be averaging of the current frame, the prior frame and the subsequent frame. The effect of combining, by averaging or other computations, can serve to smooth out the transitions of brightness level. Other limitations can be imposed to limit the rate or degree with which the brightness level can be adjusted.

Additionally, in one embodiment, brightness determinations can be done in advance. For example, a brightness determination can be processed before the associated content is to be displayed. Since the brightness determination is already known (at least partially), the content itself can include or be associated with brightness information. When the content includes such brightness information, the computational burden placed on the media device, often a portable media device, is substantially lessened. Instead, in one embodiment, the content itself can carry or associate to the brightness information. In another embodiment, a host computer (e.g., personal computer) can operate in advance to process the brightness determination.

A display device typically has a maximum brightness. The brightness control can be performed on an absolute or relative basis. For example, the relative brightness control could adjust brightness to a percentage of maximum brightness.

In controlling the display intensity, namely, brightness, of a display device, the particular one or more techniques being utilized can differ depending on the technology of the display device. For example, in the case of a liquid crystal display (LCD), the display technology typically utilizes a backlight. Hence, the display intensity of the display device can be controlled by controlling the amount of light being produced by the backlight. On the other hand, with a OLED type display, individual LEDs can be controlled, such that display intensity can be controlled by controlling individual LEDs. Here, the display intensity can be controlled on a single LED basis or on an area or group of LEDs basis.

Figure 6:
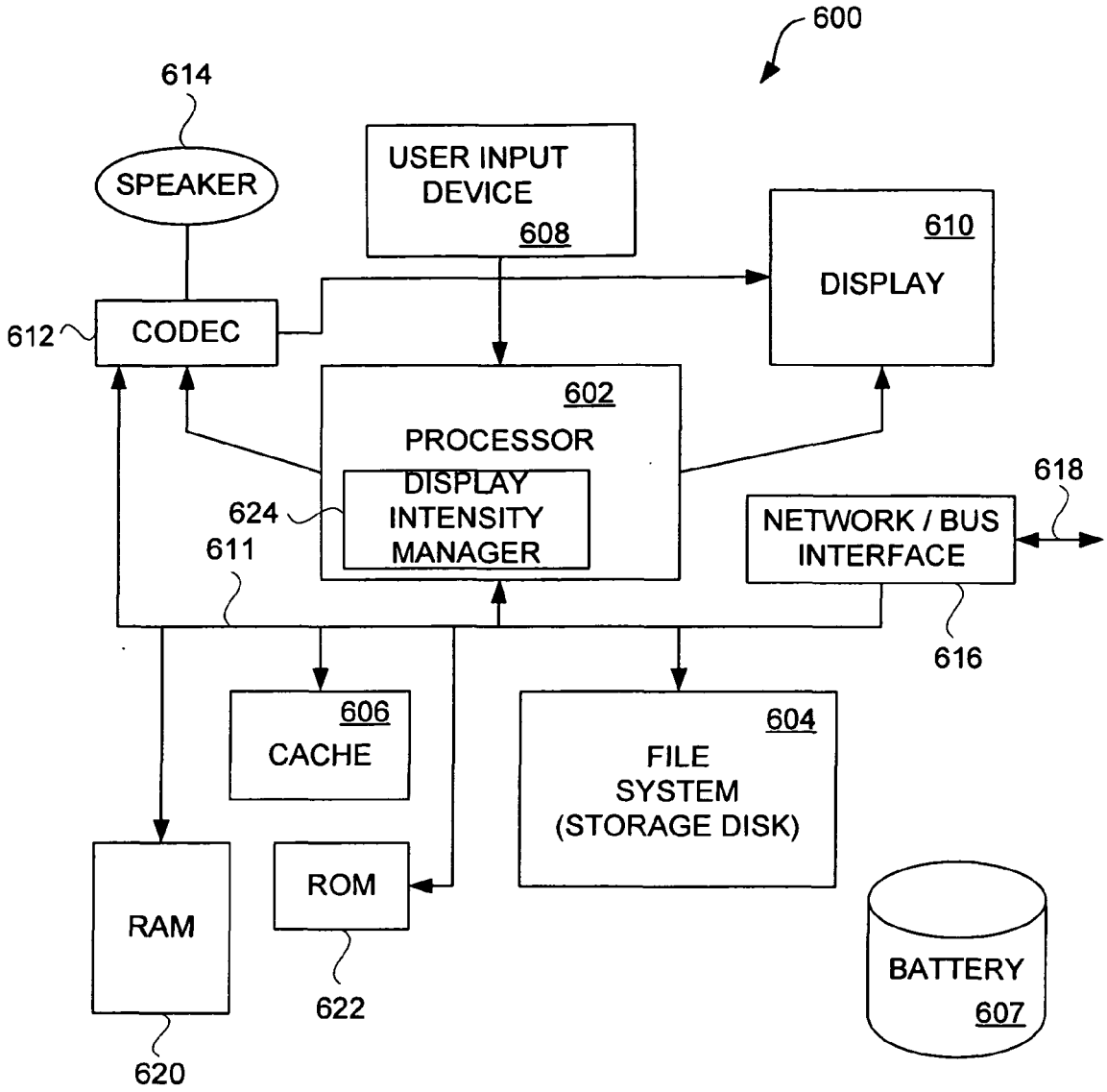
FIG. 6 is a block diagram of a media player according to one embodiment of the invention.

FIG. 6 is a block diagram of a media player 600 according to one embodiment of the invention. The media player 600 includes a processor 602 that pertains to a microprocessor or controller for controlling the overall operation of the media player 600. The media player 600 stores media data pertaining to media items in a file system 604. More particularly, media files for the media items are stored in the file system 604. The file system 604 is typically a mass storage device, such as a storage disk or a plurality of disks. Alternatively, the file system 604 can be provided by other non-volatile data storage devices, such as EEPROM or FLASH memory. The file system 604 typically provides high capacity storage capability for the media player 600. The file system 604 can store not only media data but also non-media data (e.g., when operated in a data storage or disk mode). However, since the access time to the file system 604 is relatively slow, the media player 600 can also include a cache 606 (cache memory). The cache 606 is, for example, Random-Access Memory (RAM) provided by semiconductor memory. The relative access time to the cache 606 is substantially shorter than for the file system 604. However, the cache 606 does not have the large storage capacity of the file system 604. Further, the file system 604, when active, consumes substantially more power than does the cache 606. Since the media player 600 is normally a portable media player that is powered by a battery 607, power consumption is a general concern. Hence, use of the cache 606 can enable the file system 604 to be inactive or off more often than if no cache 606 were used, thereby reducing power consumption of the portable media player.

The media player 600 also includes a user input device 608 that allows a user of the media player 600 to interact with the media player 600. For example, the user input device 608 can take a variety of forms, such as a button, keypad, dial, etc. Still further, the media player 600 includes a display 610 (screen display) that can be controlled by the processor 602 to display information to the user. A data bus 611 can facilitate data transfer between at least the file system 604, the cache 606, the processor 602, and a coder/decoder (CODEC) 612.

In one embodiment, the media player 600 serves to store a plurality of media items (e.g., videos) in the file system 604. When a user desires to have the media player 600 play a particular media item, a list of available media items can be displayed on the display 610. Then, using the user input device 608, a user can select one of the available media items. Upon receiving a selection of a particular media item, the media data (e.g., video file) for the particular media item is accessed by the processor 602 and then supplied to a coder/decoder (CODEC) 612. In the case of video and audio output, the CODEC 612 produces video output signals for the display 610 (or a display driver) and produces analog output signals for a speaker 614 (in this case the CODEC 612 can include one CODEC for audio and another CODEC for video). The speaker 614 can be a speaker internal to the media player 600 or external to the media player 600. For example, headphones or earphones that connect to the media player 600 would be considered an external speaker.

The media player 600 also includes a network/bus interface 616 that couples to a data link 618. The data link 618 allows the media player 600 to couple to a host computer. The data link 618 can be provided over a wired connection or a wireless connection. In the case of a wireless connection, the network/bus interface 616 can include a wireless transceiver.

Further, the media player 600 also includes a RAM 620 and a Read-Only Memory (ROM) 622. The ROM 622 can store programs, utilities or processes to be executed in a non-volatile manner. The ROM 622 can be implemented such that it is re-programmable, e.g., using EEPROM or FLASH technologies. The RAM 620 provides volatile data storage, such as for the cache 606.

Moreover, the processor 602 includes a display intensity manger 624. The display intensity manager 624 can be a software module or a hardware component internal to the processor 602. Alternatively, the display intensity manager 624 could be a separate software module or hardware components external to the processor 602. For example, another hardware component that includes the display intensity manager 624 could be the CODEC 612, a display controller or a graphics controller. The display intensity manager 624 can manage display intensity (e.g., brightness) of the display 610 in a dynamic and automatic fashion. The display intensity manager 624 can perform any of the processing noted above with regard to FIGS. 1-4. In general, the display intensity manager 624 manages the display intensity for the display 610 such that the display intensity is lowered at appropriate times so that power consumption by the display 610 can be reduced without having any significant detrimental effect on the user's experience in using the display 610.

Another feature of the invention is that when the display intensity (e.g., brightness) level is to be reduced, the reduction in display intensity can be done smoothly in all cases but the rate in which the display intensity is reduced can vary over a number of step reductions. For example, when the device detects a user input, the display can be activated for a predetermined period of time, then if no additional inputs have been received during the predetermined period of time, the display device can be deactivated. Alternatively, the predetermined period of time can be reduced into two or more segments. Then, after each segment, the display intensity level can be stepwise reduced.

Although the above-described techniques operate to dynamically control output intensity of a display device, it should be understood that these above-described techniques can be used separately or in conjunction with various other power saving approaches known in the art. For example, the output intensity of a display device might also be influenced by ambient light in the vicinity of the media device. As another example, the output intensity of a display device might also be influenced by the available power source, whereby output intensity can vary depending upon whether the media device is operating under battery power or AC power.

As used herein, a display device is also referred to as a display. The display device can be based on a variety of different technologies. The different technologies can control their output intensity in different ways. A liquid crystal display (LCD) typically utilizes a backlight to provide its output intensity. A OLED type display typically controls individual LEDs to provide its output intensity.

In one embodiment, a portable media device is a portable computing device dedicated, at least in part, to processing media such as audio, video or images. For example, the media player 100 can be a media player (e.g., MP3 player, video player), a game player, a video recorder, a camera, an image viewer and the like. These devices are generally battery operated and highly portable so as to allow a user to listen to music, play games or videos, record video or take pictures wherever the user travels. In one implementation, the media player is a handheld device that is sized for placement into a pocket or hand of the user. By being handheld, the media player is relatively small and easily handled and utilized by its user. By being pocket-sized, the user does not have to directly carry the device and therefore the device can be taken almost anywhere the user travels (e.g., the user is not limited by carrying a large, bulky and often heavy device, as in a portable computer). Furthermore, the device may be operated by the users hands, no reference surface such as a desktop is needed.

The various aspects, embodiments, implementations or features of the invention can be used separately or in any combination.

The invention can be implemented by software, hardware or a combination of hardware and software. The invention can also be embodied as computer readable code on a computer readable medium. The computer readable medium is any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The advantages of the invention are numerous. Different aspects, embodiments or implementations may yield one or more of the following advantages. One advantage of the invention is that power consumption of a display device can be reduced by managing its display intensity level. Another advantage of the invention is that the display intensity can be reduced without significant detriment to output quality or user experience. By taking into consideration the type of content and/or the characteristics of the content being or to be displayed, the display intensity level can be intelligently controlled to reduce power consumption by the display device. Still another advantage of the invention is that one or more user preferences can be used to influence the type, degree or amount of display intensity management to be performed.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described.

Hence, all suitable modifications and equivalents may be resorted to as falling within the scope of the invention.

What is claimed is:

1. A method for conserving power by controlling display intensity of a display device incorporated in a power limited portable electronic device for identified content to be displayed on the display device, the content having a content type associated therewith, wherein an external device wirelessly coupled to the portable electronic device determines the content type of the identified content and identifies a user preference set for the determined content type, the method comprising:

receiving at the portable electronic device from the external device a brightness level for the identified content determined by the external device, wherein the brightness level for the identified content to be displayed is determined based on the identified user preference and determined content type associated with the identified content; and after receiving the brightness level at the portable electronic device, adjusting an output intensity level for the display device of the portable electronic device based on the brightness level received.

2. The method of claim 1, wherein the output intensity level is adjusted to maximum intensity based on the brightness level received.

3. The method of claim 1, wherein the output intensity level is adjusted on a relative basis, wherein the output intensity level is set to a certain percentage of maximum intensity.

4. The method of claim 1, wherein the external device is a host computer, the host computer operating in advance of sending the brightness level to determine the brightness level and associate the brightness level with the identified content thereby alleviating a video processing computational burden from the display device.

5. The method of claim 4, wherein the host computer examines the identified content to be displayed to identify a dominant content type from a plurality of different visual content types, determines a particular output intensity level associated with the dominant content type, associates information in accordance with the particular output intensity level with the content, and sends the content and the associated information to the display having reduced computational resources, the information used by the reduced computational resource display to alter intensity of displayed content in accordance with the received information.

6. The method of claim 5, wherein the information is used by the reduced computational resource display to alter intensity of the displayed content without incurring a computational burden from examining the content to identify a dominant content type.

7. The method of claim 5, wherein the plurality of visual content types include text and images.

8. The method of claim 5, wherein the plurality of visual content types include text and video.

9. The method of claim 5, wherein the plurality of visual content types include text, video, and images.

10. A power-limited video display device comprising:

a display portion for displaying video content;

a processor, wherein the processor is configured to preserve power consumption by the video display device by adjusting an output intensity of all of the display portion based upon video brightness information received prior to adjusting the output intensity, wherein the video brightness information is based in part upon a type of video content and a user preference associated with the type of video content, wherein the video brightness information is determined by and associated with the video content by an external device during preprocessing prior to the video brightness information being received by the video display device.

11. The power-limited video display device of claim 10, wherein the processor adjusts the output intensity over a number of step reductions or increases.

12. The power-limited video display device of claim 10, wherein the video display device is a portable media device.

13. The power-limited video display device of claim 10, wherein the display portion is a liquid crystal display.

14. A non-transitory computer readable medium storing at least executable computer program code for controlling a power-limited display device, wherein the display device has a display portion for displaying visual content, the computer readable medium comprising:

executable computer code for receiving preprocessed visual content data at the display device, the visual content data including information corresponding to a content type and brightness information, wherein the brightness information is determined by an external device based in part upon the content type and a user preference associated with the content type wherein the external device associates the brightness information with the visual content data prior to sending the preprocessed visual content data to the display device; and executable computer code for adjusting an output intensity level of all of the display portion in accordance with the brightness information received with the preprocessed visual content data.

15. The non-transitory computer readable medium of claim 14, wherein if the visual content data is text, the output intensity level is set to a level lower than if the visual content data is an image.

16. The non-transitory computer readable medium of claim 14, wherein the display portion is an LED.

17. The non-transitory computer readable medium of claim 14, wherein the display portion if an OLED.

18. A non-transitory computer readable medium storing at least executable computer program code for performing pre-display processing of content to be displayed, wherein the content comprises a plurality of different visual content types, comprising:

executable computer code for, on a host device, examining the content to identify a dominant content type from the plurality of different visual content types;

executable computer code for determining a particular output intensity level associated with the dominant content type based on the identified dominant content type and a user preference associated with the identified content type; and executable computer code for sending the content to a portable media device along with information regarding the particular output intensity level after the executable computer code determines the particular output intensity level associated with the dominant content type, such that the portable media device can utilize the information to alter display intensity of a display to match the particular output intensity level without incurring a computational burden from examining the content to identify a dominant content type, wherein display intensity of the display can be altered after the portable media device receives the content and the information regarding the particular output intensity level.

19. The non-transitory computer readable medium of claim 18, wherein the plurality of visual content types include text and images.

20. The non-transitory computer readable medium of claim 18, wherein the plurality of visual content types include text and video.

21. The non-transitory computer readable medium of claim 18, wherein the plurality of visual content types include text, video, and images.

22. A power-limited portable electronic device comprising:

a battery;

a display;

an interface capable of connecting to a host device;

an adjustable illumination circuit coupled to the battery, the display, and the interface and configured to:

receive video content and brightness information preprocessed by the host device, wherein the brightness information is determined by the host device based on the video content including information corresponding to a video content type and a user preference set for the video content type, wherein the video content is preprocessed by associating the video brightness information with the video content; and after receiving the video content preprocessed by the host device, adjust the adjustable illumination circuit based on the video brightness information received with the preprocessed video content, wherein the adjustable illumination circuit affects the brightness of the entire display regardless of how much of the display is currently playing the video content type.

23. The power-limited portable electronic device of claim 22, further comprising sending to the host device information regarding characteristics of the display of the power-limited electronic device for use by the host device in preprocessing the video content.

24. The power-limited portable electronic device of claim 22, wherein the interface is a wireless interface.

25. The power-limited portable electronic device of claim 22, wherein the interface is a wired interface.

26. The power-limited portable electronic device of claim 22, wherein the adjustable illumination circuit directly reduces power used from the battery when causing the brightness of the display to be reduced.

27. A method for pre-processing, at a host device, content to be displayed on a power-limited portable electronic device having reduced computational resources, wherein the content comprises a plurality of different visual content types, the method comprising:

examining the content to be displayed to identify a dominant content type from the plurality of different visual content types;

determining a user preference associated with the dominant content type;

associating information regarding the user preference with the content; and after associating information regarding the user preference with the content, sending the content and the associated information to the power-limited portable electronic device, the information being used by the power-limited portable electronic device to alter output intensity level of the display based on the retrieved information.

28. The method of claim 27, wherein the retrieving and the sending are performed over a wireless transmission medium.

29. The method of claim 27, wherein an intensity of a display of the power-limited portable electronic device affects an amount of power used by the display and affects the intensity of the entire display, regardless of whether the display is showing the dominant content type or other content types, either alone or simultaneously.

30. The method of claim 27, wherein the method further comprises retrieving information regarding a maximum brightness of the display.

31. The method of claim 27, wherein the user preference is stored by the host device.

32. The method of claim 27, wherein the method further comprises determining a particular output intensity level associated with the dominant content type, wherein the particular output intensity level can be varied based on ambient light in the vicinity of the display.

33. The method of claim 31, wherein user preferences stored on the host device specify a particular percentage of maximum brightness for each of the plurality of visual content types.

34. The method of claim 27, wherein the dominant visual content type is selected based on colors of the plurality of visual content types.

35. The method of claim 27, wherein the dominant visual content type is selected based on contrasts of the plurality of visual content types.

36. The method of claim 32, wherein the dominant visual content type is selected based on brightness levels of the plurality of visual content types.

37. The method of claim 27, wherein the particular output intensity level is selected based on each frame of the content.

* * * * *

UNITED STATES PATENT AND TRADEMARK OFFICE

CERTIFICATE OF CORRECTION

PATENT NO. : 8,358,273 B2
APPLICATION NO. : 11/439613
DATED : January 22, 2013
INVENTOR(S) : Andrew Bert Hodge et al.

It is certified that error appears in the above-identified patent and that said Letters Patent is hereby corrected as shown below:

On the title page

Page 4 of Cited References, Other Publications, first column, 26th reference (Combination Belt Clip...), second line, replace "Motorla" with --Motorola--.

Page 4 of Cited References, Other Publications, second column, 9th reference (Rocky Matrix Backlit Keyboard), second line, replace "www.arnrel.com" with --www.amrel.com--.

Page 5 of Cited References, Other Publications, first column, 6th reference (Sony Ericsson to introde Auto pairing...), fourth line, remove space between "spg.j" and "sp?".

Signed and Sealed this
Twentieth Day of May, 2014

Michelle K. Lee

Michelle K. Lee
*Deputy Director of the United States Patent and Trademark Office*